US006012514A

United States Patent [19]

Swain

[11] Patent Number: 6,012,514

[45] Date of Patent: Jan. 11, 2000

[54] TUBE-IN TUBE HEAT EXCHANGER

[76] Inventor: Robert L. B. Swain, 460 McLaws Cir., Suite 150, Williamsburg, Va. 23185

[21] Appl. No.: 08/978,986

[22] Filed: Nov. 26, 1997

[51] Int. Cl.[7] ..... F28D 7/10

[52] U.S. Cl. ..... 165/154; 165/143; 165/160

[58] Field of Search ..... 165/154, 143, 165/160, 299, 156

[56] References Cited

U.S. PATENT DOCUMENTS

| | | | |
|---|---|---|---|
| 351,583 | 10/1886 | Dixon | 165/143 |
| 367,601 | 8/1887 | Dashiell | 165/143 |
| 694,797 | 3/1902 | Siebert | 165/143 |
| 1,683,236 | 9/1928 | Braun | 165/160 |
| 2,125,972 | 8/1938 | Wilson et al. | 165/143 |
| 2,545,280 | 3/1951 | Hollmeyer et al. | 165/143 |
| 2,633,338 | 3/1953 | Hiersch | 165/143 |
| 3,018,090 | 2/1962 | Kaase et al. | 165/143 |
| 3,134,431 | 5/1964 | Astrup | 165/160 |
| 3,930,536 | 1/1976 | Cherry et al. | 165/143 |
| 4,254,826 | 3/1981 | Adams | 165/143 |
| 4,372,374 | 2/1983 | Lee | 165/70 |
| 4,469,088 | 9/1984 | Anzai et al. | 165/104.17 |
| 4,529,033 | 7/1985 | Blum | 165/299 |
| 4,697,637 | 10/1987 | Young | 165/160 |
| 5,004,046 | 4/1991 | Jones | 165/156 |
| 5,492,336 | 2/1996 | Barna et al. . | |
| 5,499,639 | 3/1996 | Williams, Jr. . | |

*Primary Examiner*—Ira S. Lazarus
*Assistant Examiner*—Terrell McKinnon
*Attorney, Agent, or Firm*—Joy L. Bryant

[57] ABSTRACT

A tube-in-tube heat exchanger for exchanging heat between two fluids is provided. The heat exchanger has at least one tube pair; spaced apart first and second tube sheets; first and second annular flow chambers; and first and second inner tube flow chambers. A gasket surrounds each inner tube of each tube pair at each end, forming a seal between each annular flow chamber, each inner tube flow chamber, and each inner tube. Such configuration allows for modular construction and easy cleaning and replacement of fouled or damaged tubes.

17 Claims, 4 Drawing Sheets

TUBE-IN TUBE HEAT EXCHANGER

FIELD OF THE INVENTION

The present invention relates to heat exchangers. In particular, it relates to tube-in-tube heat exchangers for exchanging heat between two fluids.

BACKGROUND OF THE INVENTION

Heat exchangers are used in many industries to remove heat from one fluid and transfer the heat to another fluid. A variety of heat exchanger designs are available, and each basic design has many possible configurations and materials of construction. The design chosen for a specific application depends on the conditions under which the heat exchanger must operate and the function it must perform.

When the fluids passing through a heat exchanger are clean and not likely to form deposits on the heat transfer surfaces, any of the designs capable of handling the temperatures and pressures imposed by the application can be used. However, if both fluids contain particulate matter or have a tendency to form deposits on the heat transfer surfaces, the available options become limited.

Shell-and-tube heat exchangers are the workhorses of the chemical process industry, but are generally unacceptable for handling liquids containing solids on the shell side of the exchanger. The multiple tubes act similarly to a filter, and the shell side quickly plugs with the solids.

Wide-gap plate-and-frame heat exchangers can sometimes be used to transfer heat between two fluids containing particulate matter but only if the matter is not fibrous in geometry and at the expense of a very high pressure drop across the exchanger. In addition, the flow channels in a plate-and-frame heat exchanger contain many contact points between adjacent plates, which serve as points where solids begin accumulating to subsequently clog the open portions of the flow channels.

Spiral heat exchangers are most often used for this difficult application, since they are generally resistant to plugging by solids. However, they are very large and expensive compared to the other heat exchangers available. Since they are available in a limited range of sizes, off-optimum comprises are often necessary.

An object of the present invention is to provide a heat exchanger which is capable of transferring heat between any two fluids. In particular, the heat exchanger of the present invention works well for those applications where both fluids are contaminated with solids or substances which are prone to accumulate on heat transfer surfaces.

Another object of the present invention is to provide a heat exchanger which is less expensive to build than a spiral heat exchanger.

Another object of the present invention is to provide a heat exchanger which is easy to clean and maintain.

Another object of the present invention is to provide a heat exchanger which is compact in size.

Another object of the present invention is to provide a heat exchanger which can be easily customized to permit optimization of flow velocity and heat transfer surface for a variety of applications.

Another object of the present invention is to provide a heat exchanger which contains built-in provisions to permit its parts, which are typically metal, to independently expand or contract due to different temperatures without placing excessive stress or strain on the heat exchanger assembly.

SUMMARY OF THE INVENTION

The foregoing objects are accomplished by the present invention which is a tube-in-tube heat exchanger that allows for the exchange of heat between two fluids. The heat exchanger is comprised of three main sections: an inner section; two opposing annular flow chambers; and two opposing inner tube flow chambers. The inner section has at least one tube pair. The tube pair is configured such that an inner tube, having a small diameter, is contained within and protrudes from an outer tube. The outer tube has a larger diameter than the inner tube but is of a shorter length than the inner tube. When fluids flow through the tube pair, the fluid contained in the inner tube is defined as an inner tube fluid. The fluid which flows through the outer tube and thus, surrounds the inner tube, is defined as an annular fluid.

The outer tubes are connected at each end to a pair of spaced apart first and second tube sheets. Each tube sheet has holes bored in it. The size of the holes are approximately equal to the outer diameter of the outer tubes. The number of bores is equal to the number of tube pairs. The end portion of the outer tube of each tube pair is connected to each tube sheet in alignment with each hole to allow the annular fluid to flow out of the tube pair and into the annular chambers. When a connection is made such that fluid can flow from one section of the heat exchanger to another, this type of connection is called flow communication. Since the inner tube is longer than the outer tube, the inner tube passes through and beyond the tube sheet while the outer tube terminates at the tube sheet. Thus, the inner section comprises at least one tube pair and a tube sheet located at each end of the outer tube, with the inner tube extending through and beyond the tube sheet.

First and second annular flow chambers are attached to each tube sheet on the side which is opposite to the tube pair. The annular flow chambers allow for passage and direction of the annular fluid throughout the heat exchanger. Each annular flow chamber has an inner face and an outer face spaced apart from the inner face. Each inner face and outer face has a number of bores therein for receiving the inner tubes. The number of bores is approximately equal in size and equal in number to the inner tubes and each bore has edges. To prevent annular fluid leakage, a gasket is positioned between the tube sheet and the inner face of the annular flow chamber. The annular fluid is introduced into the heat exchanger through an annular fluid inlet which is positioned in an operable relationship to either the first annular flow chamber or the second annular flow chamber. Likewise, removal of the annular fluid from the heat exchanger takes place through an annular fluid outlet which is positioned in an operable relationship to either the first annular flow chamber or the second annular flow chamber. The operable relationship is defined by the number of passes in the heat exchanger or the number of times the fluid flows from one end of the heat exchanger to the other. In order to avoid mixing of the annular fluid with the inner tube fluid, each inner tube extends through each annular flow chamber and protrudes from each bore in each outer face.

An inner tube gasket is placed around the outer circumference of each end portion of each inner tube as it extends beyond the outer face of the annular flow chamber. Such a gasket may be a single sheet of standard gasket material known to those skilled in the art or individual gaskets such as o-rings. In either instance, the gasket must surround each end portion of each and every inner tube.

First and second inner tube flow chambers are positioned in flow communication with each outer face of each annular flow chamber. The inner tube flow chambers allow for passage and direction of the inner tube fluid throughout the heat exchanger. An inner tube fluid inlet is placed in an operable relationship to either the first inner tube flow chamber or the second inner tube flow chamber to allow for introduction of the inner tube fluid into the heat exchanger. Similarly, an inner tube fluid outlet is positioned in an operable relationship to either the first inner tube flow chamber or the second inner tube chamber depending on the number of passes in the heat exchanger. Each inner tube flow chamber has an inner face, an opposing outer face, spaced apart from the inner face, and an outer cover plate adjacent to the outer face. A gasket is positioned between the outer face and the outer cover plate. The inner face has a number of bores therein for receiving each inner tube to allow the inner tube fluid to enter into the inner tube flow chamber. The number of bores is approximately equal in size and equal in number to the inner tubes and each bore has edges. As the inner face of each inner tube flow chamber is seated against the outer face of each annular flow chamber, the gasket which is surrounding each inner tube is compressed to form a seal between the two chambers and the inner tubes. The edges of the bores in the mating faces of the annular flow chamber and the inner tube flow chamber may be modified by chamfering or grooving the holes to enhance the clamping force of the gasket on the outer surface of the inner tube, or to permit the use of a relatively incompressible gasket material, such as asbestos or polytetrafluoroethylene (PTFE).

One can observe that by reversing the assembly process, the heat exchanger can be easily disassembled to permit mechanical cleaning or replacement of tubes which have become severely fouled or damaged in service. This is just one of the many advantages of the present invention and additional objects and advantages of the invention will be set forth in part in the description which follows, and in part will be obvious from the description, or may be learned by practice of the invention. The objects and advantages of the invention will be obtained by means of instrumentalities in combinations particularly pointed out in the appended claims.

BRIEF DESCRIPTION OF THE DRAWINGS

The accompanying drawings illustrate a complete embodiment of the invention according to the best modes so far devised for the practical application of the principles thereof, and in which.

DETAILED DESCRIPTION OF PREFERRED EMBODIMENTS OF THE INVENTION

The tube-in-tube heat exchanger of the present invention allows for the exchange of heat between two fluids. Although the invention will be described on a single element basis, many of these elements may be combined together to form a pre-assembly before the final fabrication of the heat exchanger. Such a "modular" design helps reduce construction costs, especially for those applications where a large heat exchanger is required. Careful design and alignment of the inlet and outlet nozzles allows for multiple modules to be stacked together in parallel and series to create a heat exchanger optimized for flow velocity and total heat transfer area. Moreover, the modular design allows for easy disassembly to permit mechanical cleaning or replacement of fouled or damaged tubes.

Figure 1:
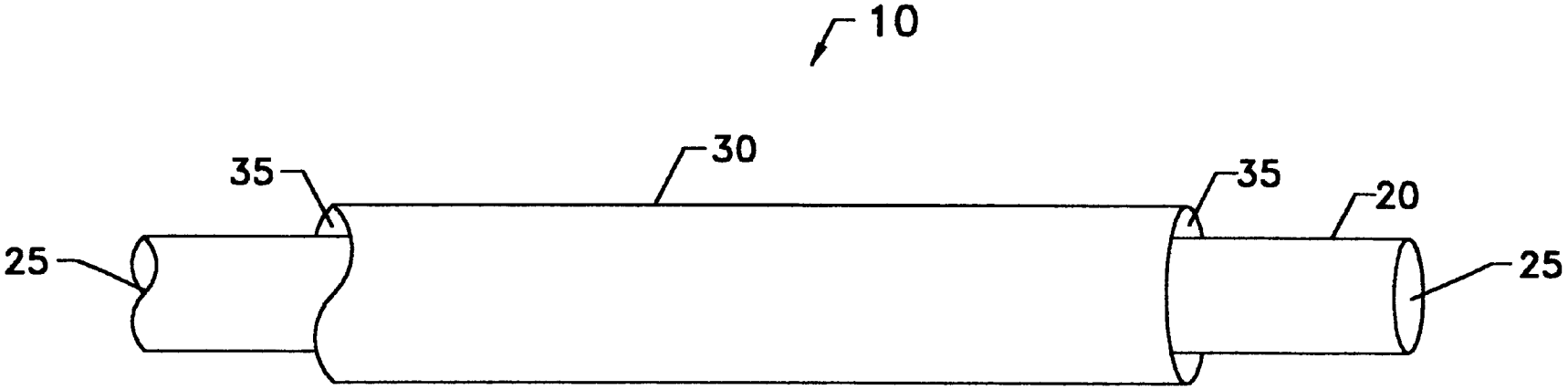
FIG. 1 is a perspective view of a tube pair.

In the drawings, similar elements are numbered the same. For simplicity, the drawings are shown and described for a two dimensional configuration. However, in practice, the tube pairs may be aligned to form an array such that the heat exchanger is actually three dimensional. FIG. 1 depicts a tube pair 10. The tube pair 10 comprises an inner tube 20 disposed within and protruding from an outer tube 30. The inner tube 20 is longer than the outer tube 30. The inner tube 20 and the outer tube 30 each have end portions 25 and 35, respectively. The inner tube 20 has a smaller diameter than the outer tube 30 and both tubes 20 and 30 have the same longitudinal axis. The inner tube 20 may have a plain surface or preferably, it has a modified heat transfer surface to generate turbulent flow. This surface modification is accomplished by any method known to those skilled in the art and in particular by twisting or fluting the tube to produce spiral shaped ridges for the majority of the length of the inner tube, yet leaving plain unmodified ends for a smooth sealing surface. The twisted or fluted tube design works well for viscous fluids because it creates turbulence that improves the heat transfer coefficient.

When the heat exchanger is in use, a fluid flows through the inside of the inner tube 20 and for the purpose of this specification and the appended claims, the fluid is defined as an inner tube fluid. In turn, a second fluid flows through the outer tube 30 in the annular area between the outer surface of the inner tube 20 and the inner surface of the outer tube 30. For the purpose of this specification and the appended claims such a fluid is defined as an annular fluid. Preferably, the inner fluid flows in a direction opposite to the flow of the annular fluid.

Figure 2:
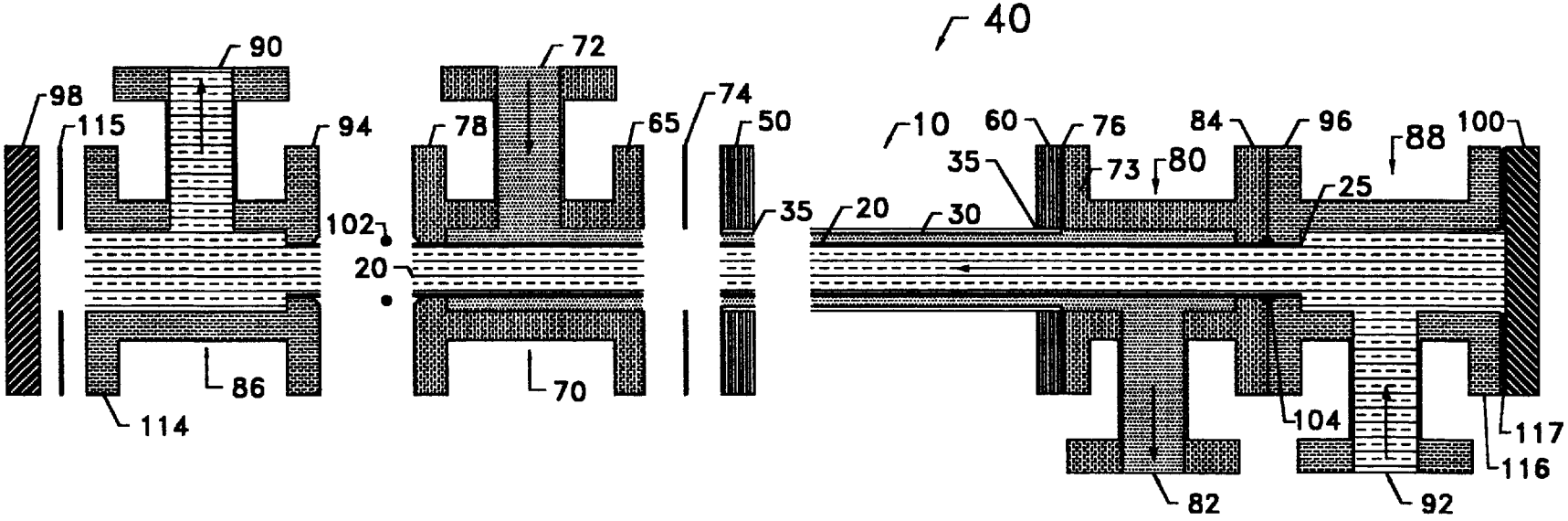
FIG. 2 is a cross-sectional view of a single-pass heat-exchanger, with one end exploded.
Figure 3:
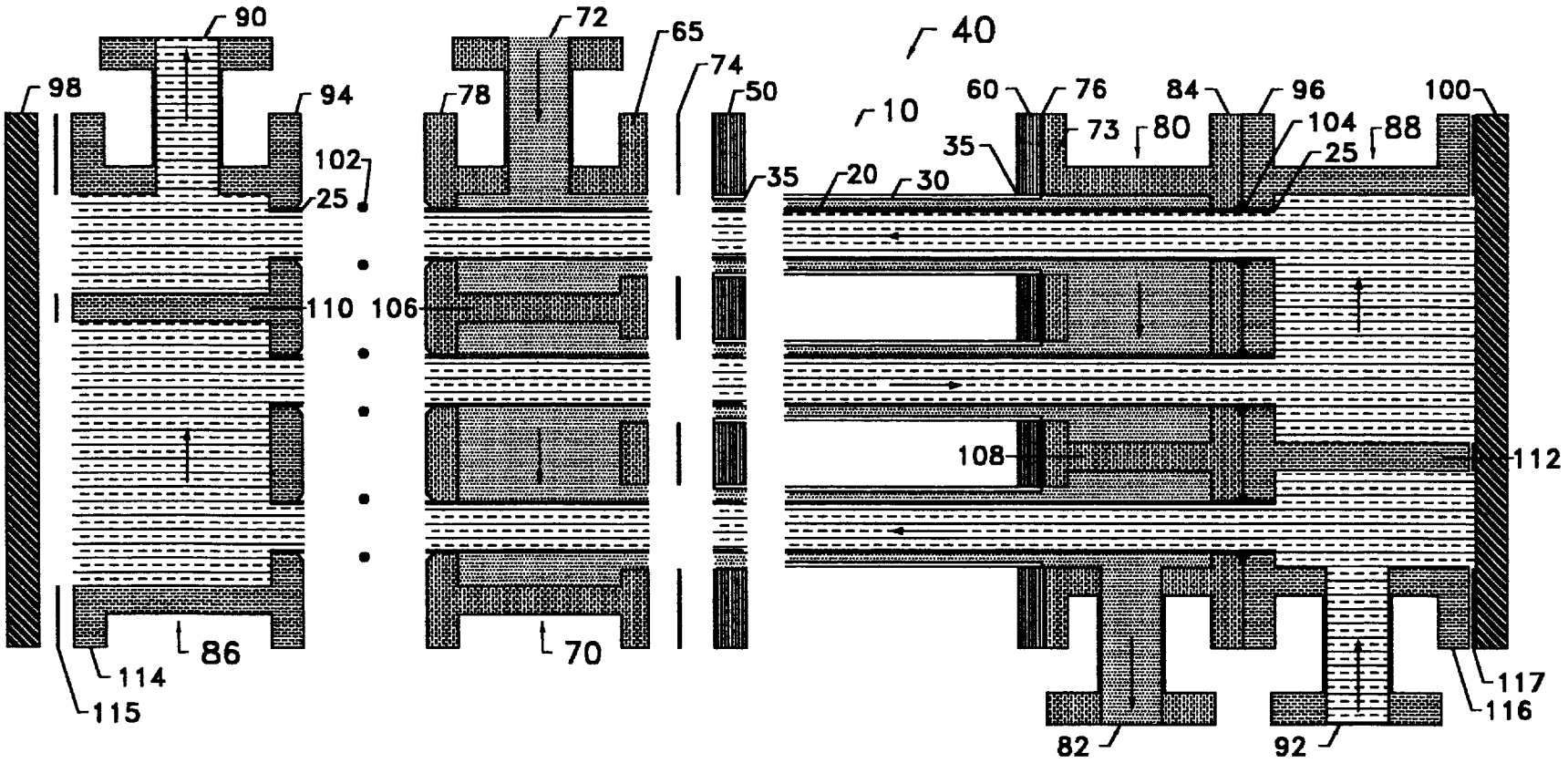
FIG. 3 is a cross-sectional view of a heat-exchanger, with one end exploded, and having an odd number of passes.
Figure 4:
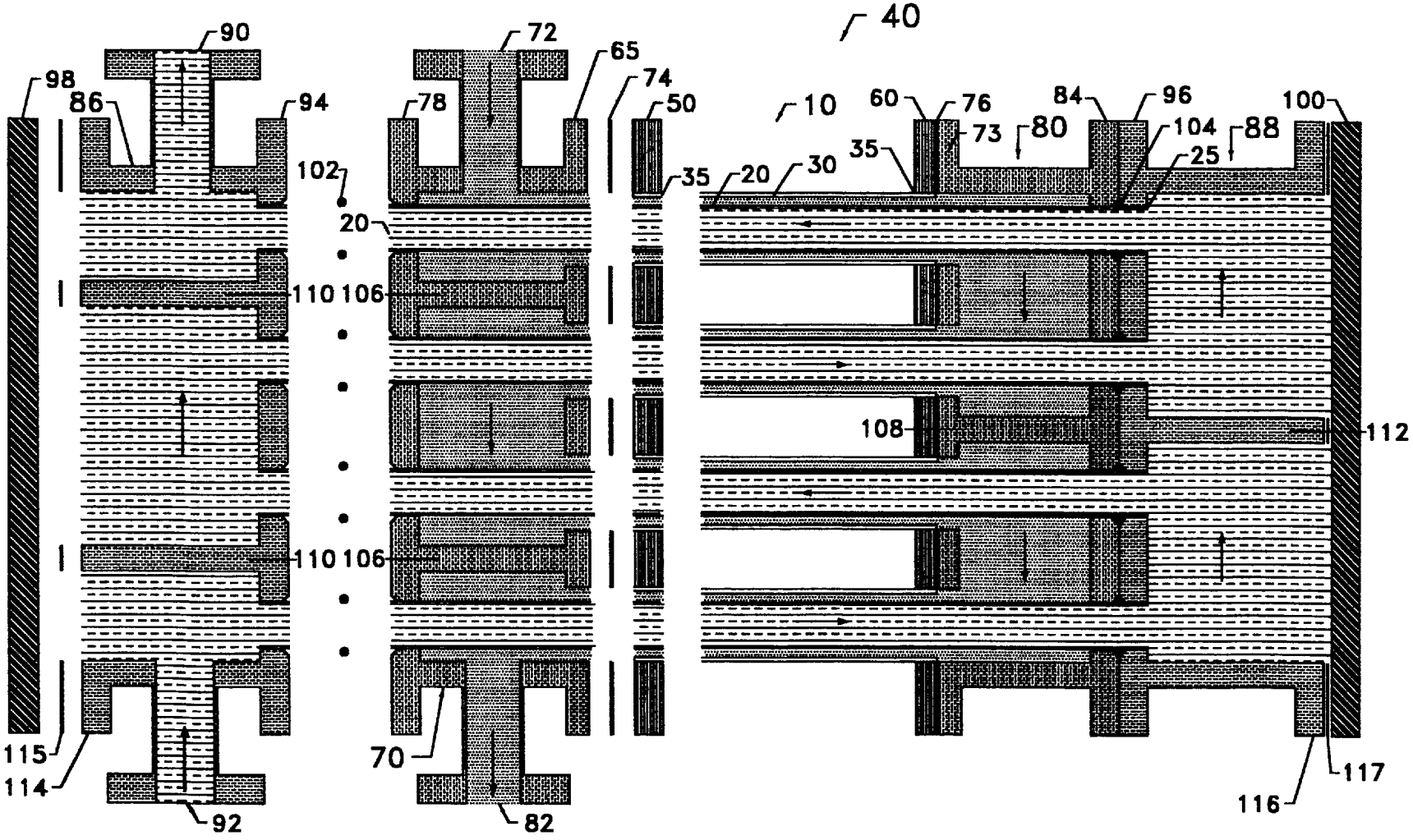
FIG. 4 is a cross-sectional view of a heat-exchanger, with one end exploded, and having an even number of passes.

FIG. 2 depicts the most simplistic form of the tube-in-tube heat exchanger of the present invention, where a single pass is involved. A "pass" is defined as the number of times the fluid flows from one end of the heat exchanger to the opposite end. In a single pass heat exchanger, the fluid enters at one end and exits at the other end without changing direction. Similarly, in an odd numbered multi-pass heat exchanger, the fluid enters at one end, and exits at the other end as shown in FIG. 3. In this instance, the fluid makes two 180 degree directional changes in the heat exchanger before it exits the heat exchanger; thereby traveling from one end of the heat exchanger to the other three times, making it a three-pass heat exchanger. In a heat exchanger having an even number of passes as shown in FIG. 4, the fluid enters on a first end and flows in one direction until it reaches the other end of the exchanger where it changes direction by 180 degrees and returns to the first end through a different flow passage. The fluid in an even pass heat exchanger exits the assembly from the same end and preferably on the opposite side of the assembly from where the fluid originally entered it.

FIG. 2 shows an exploded cross-sectional view of a heat exchanger 40 having a single-pass. The heat exchanger 40 comprises a single tube pair 10. A first tube sheet 50 is spaced apart from a second tube sheet 60 at a distance approximately equal to the length of the outer tube 30. Each tube sheet 50 and 60 has a bore therein for receiving the tube pair 10. The size of the bore is about equal to the outer diameter of the outer tube 30 such that the outer tube fits within the bore in the tube sheet and is connected to it to form a leak-free connection. The number of bores is equal to the number of tube pairs 10. For the single tube pair, single pass heat exchanger 40 shown in FIG. 2, the number of bores in each tube sheet 50 and 60 is equal to one. For the heat exchanger 40 shown in FIG. 3, there are three bores per tube sheet 50 and 60 and four bores are shown in each tube sheet 50 and 60 in FIG. 4. FIGS. 2–4 show that the inner tube 20 extends through the bore in each tube sheet 50 and 60. The outer tube 30 is secured to the tube sheets 50 and 60 at each end 35 by any method known to those skilled in the art wherein both a leak-free interface joint and the physical strength required by the pressure and temperature of the application are provided. These requirements are typically met by welding, brazing, expanding, soldering or cementing techniques.

A first annular flow chamber 70 and a second annular flow chamber 80 are also provided. The annular flow chambers 70 and 80 are configured to contain and direct the annular fluid as it enters or exits the annular flow area of each tube pair 10. The shape of the annular flow chamber does not have to be rectangular, as shown, but may be fabricated in any shape which will provide the desired result. An annular fluid inlet 72 and an annular fluid outlet 82 are each positioned in an operable relationship to the first annular flow chamber 70 and the second annular flow chamber 80. The annular fluid inlet 72 allows fluid to enter the annular flow chamber 70 where the annular fluid outlet 82 is used to remove the annular fluid from the heat exchanger. When defining the operable relationship, one must take into consideration the number of passes involved in the heat exchanger, as was mentioned earlier. For the single pass heat exchanger shown in FIG. 2, the annular fluid inlet 72 and the annular fluid outlet 82 are at opposite ends of the heat exchanger 40. FIG. 3 also shows a similar arrangement for an odd number of passes. Alternatively, FIG. 4 shows the annular fluid inlet 72 and outlet 82 on the same end of the heat exchanger 40 but preferably on opposite sides of the assembly when there are an even number of passes.

Each annular flow chamber 70 and 80 has an inner face 65 and 73 which is attached to each respective tube sheet 50 and 60 on the side which is opposite to the tube pair 10. Each inner face 65 and 73 has a number of bores therein to allow for passage of the annular fluid and the inner tubes 20. A gasket 74 and 76 is disposed between each inner face 65 and 73 of each annular flow chamber 70 and 80 and each tube sheet 50 and 60 to prevent leakage of the annular fluid. Each annular flow chamber 70 and 80 has an outer face 78 and 84 spaced apart from each inner face 65 and 73. Each outer face 78 and 84 has a number of bores therein for receiving each inner tube 20 and each bore has edges. The number of bores in the outer face of the annular flow chambers is equal to the number of bores in the adjacent tube sheet. Any number of bores and matching tube pairs can be used when practicing the present invention to achieve the desired result. Each inner tube 20 extends through each annular flow chamber 70 and 80 and protrudes from each bore in each outer face 78 and 84.

A first inner tube flow chamber 86 and a second inner tube flow chamber 88 are placed in flow communication with each outer face 78 and 84 of each annular flow chamber 70 and 80 to allow the inner fluid to flow through each inner tube and each inner tube flow chamber 86 and 88. The inner tube flow chambers 86 and 88 are configured to direct and contain the flow of the inner fluid as it enters or exits the flow area inside the inner tubes 20. FIG. 2 shows the first inner tube flow chamber 86 having an inner fluid outlet 90 where the second inner tube flow chamber 88 is shown having an inner fluid inlet 92. FIG. 3 shows a similar arrangement but FIG. 4 shows the inner tube fluid inlet 92 and the inner tube fluid outlet 90 both contained in the first inner tube flow chamber 86. Both inner tube flow chambers 86 and 88 have an inner face 94 and 96 and a spaced apart, opposing outer face 114 and 116 respectively. The outer face 114 is sealed to prevent leakage to the ambient space outside the heat exchanger by a gasket 115 and a cover plate 98. Likewise, the outer face 116 is sealed by a gasket 117 and a cover plate 100. Each inner face 94 and 96 has a number of bores therein for receiving each inner tube 20 such that the number of bores is equal to the number of inner tubes and each bore has an edge. Note that FIG. 2 shows one bore, FIG. 3 shows three bores and FIG. 4 shows four bores in each inner tube flow chamber. The bores are about the same size and match the alignment of the bores in the mating outer faces of the annular flow chamber 78 and 84.

A gasket 102 and 104 surrounds each inner tube 20 at each end portion to prevent leakage between each inner tube flow chamber, each annular flow chamber, and the ambient space outside of the heat exchanger. The gasket 102 and 104 may be a sheet of material with holes cut out to accommodate the inner tubes or individual gaskets which surround each and every end portion of each inner tube. For example, if individual gaskets are used for each inner tube and the heat exchanger comprises two tube pairs, one would use four gaskets, one gasket to surround each end of each inner tube. The gasket 102 and 104 is disposed between each outer face 78 and 84 of each annular flow chamber 70 and 80 and each inner face 94 and 96 of each inner tube flow chamber 86 and 88 and is compressed to form a seal. Preferably, the bores in the outer face 78 and 84 of each annular flow chamber 70 and 80 and the inner face 94 and 96 of each inner tube flow chamber 86 and 88 are modified for enhanced sealing by the gaskets by grooving or chamfering the edges of the bores.

FIGS. 3 and 4 show multi-pass embodiments where at least one partition 106 and 108 is positioned between each inner face 65 and 73 and each outer face 78 and 84 of each annular flow chamber 70 and 80 for directing the annular fluid flow. Likewise, at least one partition 110 and 112 is positioned between each inner face 94 and 96 and each outer face 114 and 116 of each inner tube flow chamber 86 and 88 for directing the inner fluid flow. The placement and orientation of these partitions is dependent upon the final configuration of the heat exchanger. Such partitions direct the flow to provide the desired number of passes and may allow the flow to occur in parallel and series at the same time.

Additionally, each inner tube flow chamber 86 and 88 further comprises a gasket disposed between each outer face 114 and 116 of each inner tube flow chamber 86 and 88 and each outer cover plate 98 and 100 to prevent leakage of fluid between the inner tube flow chamber and the atmosphere or between adjacent partitions of the inner tube flow chamber.

EXAMPLES

Example 1

A heat exchanger having an odd number of passes is prepared in the following manner. At least one tube pair is provided. The tube pair is constructed such that an inner tube, having a modified heat transfer surface, is placed inside of an outer tube. The inner tube is longer than the outer tube and the end portions of the inner tube stick out from each end of the outer tube by a length which is sufficient to pass through the annular flow chambers. A tube sheet, having the same number of holes bored in it as tube pairs, is placed at each end of the tube pair. The ends of the outer tube are placed in flow communication with the holes in the tube sheets and the outer tube is attached to each tube sheet using standard techniques known to those skilled in the art such as welding, brazing, expanding, soldering and cementing. The inner tube extends through each hole in each tube sheet.

A gasket is positioned next to each tube sheet and the inner faces of two annular flow chambers are positioned next to the gaskets. Each annular flow chamber has an inner face and an outer face which is spaced apart from each inner face and for heat exchangers having more than one pass, has at least one partition positioned horizontally between the inner face and the outer face for directing annular fluid flow. One of the annular flow chambers has an annular fluid inlet and the other annular flow chamber has an annular fluid outlet. Each inner and outer face has holes therein for receiving each inner tube. The number of holes is equal to the number of inner tubes. Each inner tube extends through each annular flow chamber and protrudes beyond each hole in each outer face. The inner face of each annular flow chamber is attached to each tube sheet with a gasket inbetween. The means for attachment includes screws, bolts, clamps or any other means known to those skilled in the art such that the gasket is compressed between the annular flow chamber and the tube sheet. Use of these means allows for easy access to the annular flow chambers and the outer tubes.

Individual gaskets are placed around each end of each inner tube as it protrudes beyond the hole in the outer face of each annular flow chamber. These gaskets are either o-rings or of various cross-sectional geometries depending on the shape of the edge of the bores.

Two inner tube flow chambers are provided. One inner tube flow chamber has an inner tube fluid inlet and the other inner tube flow chamber has an inner tube fluid outlet. Each inner tube flow chamber has an inner face and an opposing outer face. For multiple pass exchangers, at least one partition is positioned between the inner face and the outer face of the inner tube flow chamber. Each inner face has holes in it for receiving each inner tube. The number of holes is equal to the number of inner tubes. Each inner tube flow chamber is positioned such that each inner tube extends into each hole in the inner face, and the inner face of the inner tube flow chamber is compressed against the outer face of the annular flow chamber using bolts, screws, clamps or any other means known to those skilled in the art. The gasket surrounding each inner tube is thereby compressed to form a seal between the outer face of each annular flow chamber, the inner face of each inner tube flow chamber, and each inner tube. Lastly, a gasket is placed between the outer face of each inner tube flow chamber and an outer cover plate is placed adjacent to the outer face and secured with bolts, screws, clamps or any other means known to those skilled in the art.

If one of the inner tubes were to clog or require replacement, such a configuration allows for easy maintenance and repair. One simply disassembles the heat exchanger and removes the damaged tube. A new inner tube is slid into place and a gasket attached at each end of the inner tube. The heat exchanger is then reassembled, minimizing plant down time and ultimate repair cost.

Example 2

A heat exchanger having an even number of passes is prepared in the following manner. At least two tube pairs are provided. Each tube pair is constructed such that an inner tube, having a modified heat transfer surface, is placed inside of an outer tube. The inner tube is longer than the outer tube and the end portions of the inner tube stick out from each end of the outer tube by a length which is sufficient to pass through the annular flow chambers. A tube sheet, having the same number of holes bored in it as tube pairs, is placed at each end of the outer tube pairs. The ends of the outer tubes are placed in flow communication with the holes in the tube sheets and the outer tubes are attached to each tube sheet using standard techniques known to those skilled in the art such as welding, brazing, expanding, soldering and cementing. The inner tube extends through each hole in each tube sheet.

A gasket is positioned next to each tube sheet and two annular flow chambers are each positioned next to each gasket. Each annular flow chamber has an inner face and an outer face which is spaced apart from the inner face. At least one partition is positioned horizontally between the outer face and the inner face for directing annular fluid flow. One of the annular flow chambers has an annular fluid inlet on one end and an annular fluid outlet on the other end, preferably opposite to the annular fluid inlet. The other annular flow chamber does not have an inlet or an outlet. Each inner and outer face has holes therein for receiving each inner tube. The number of holes is equal to the number of inner tubes and the edges of the holes may be modified. Such modification allows for seating gaskets of various shapes. For example, the edges may be grooved or chamfered. Each inner tube extends through each annular flow chamber and protrudes beyond each hole in each outer face.

Individual gaskets are placed around each end of each inner tube as it sticks out of the hole in the outer face of each annular flow chamber. These gaskets are either o-rings or of various cross-sectional geometries depending on the shape of the edge of the bores.

Two inner tube flow chambers are provided. One inner tube flow chamber has an inner tube fluid inlet and an inner tube fluid outlet where the inner tube fluid outlet is across from or opposite from the inner tube fluid inlet. The other inner tube flow chamber does not have an inner tube fluid inlet or outlet. Each inner tube flow chamber has an inner face and an opposing outer face and at least one partition is positioned horizontally between the inner face and the outer face. Note that for the special case of a two-pass exchanger, neither the annular flow chamber nor the inner tube flow chamber on the end of the heat exchanger opposite the fluid inlets and outlets will contain a partition. Each inner face has holes in it for receiving each inner tube. The number of holes is equal to the number of inner tubes. Each inner tube flow chamber is positioned such that each inner tube extends into each hole in the inner face and the inner face is compressed against the outer face of the annular flow chamber using any means known to those skilled in the art and in particular, bolts, screws and clamps. The gasket surrounding each inner tube is compressed to form a seal between the outer face of each annular flow chamber, the inner face of each inner tube flow chamber, and each inner tube. In addition, a gasket is placed next to the outer face of the inner tube flow chamber and an outer cover plate is attached adjacent to the outer face such that the gasket is in-between. The outer cover plate is attached by bolts, screws, clamps or any other means known to those skilled in the art.

As described in Example 1, this assembly facilitates maintenance and repair of the heat exchanger.

Example 3

A heat exchanger containing 16 tube pairs is configured as a four tube pair by four tube pair array as viewed from the end of the heat exchanger. A cross-sectional view of this example is similar to FIG. 4, where each tube-pair shown in cross-section is accompanied by three additional tube pairs laying behind it in the plane of the figure. The annular flow chambers are partitioned such that when the annular fluid enters the first annular flow chamber, it comes into contact with a horizontal partition which directs the annular fluid such that it flows into four of the annular flow areas at the same time. The annular fluid exits those tube pairs at the second annular flow chamber completing the "first pass." A horizontal partition in the second annular flow chamber causes the annular fluid to turn 180 degrees, and enter four new tube pairs to return to the first annular flow chamber completing the "second pass." When the annular fluid empties into the first annular flow chamber, it encounters a second horizontal partition which redirects the annular fluid into four more tube pairs, causing the annular fluid to flow back to the second annular flow chamber completing the "third pass." The wall of the second annular flow chamber and the horizontal partition in the second annular flow chamber force the annular fluid into a fourth set of tube pairs and back to the first annular flow chamber to complete the "fourth pass." The inner tube fluid flows within the inner tubes and inner tube flow chambers, in the opposite direction of that of the annular fluid, changing directions in the inner tube flow chambers which have been similarly partitioned.

The exchanger described, consists of four passes, with four tubes in parallel for each pass. The same exchanger could easily be partitioned to provide two passes with eight tubes in parallel for each pass, or as eight passes with two tubes in parallel per pass. By way of this example, one can appreciate the design flexibility that the present invention provides.

The above description and drawings are only illustrative of preferred embodiments which achieve the objects, features and advantages of the present invention, and it is not intended that the present invention be limited thereto. Any modification of the present invention which comes within the spirit and scope of the following claims is considered part of the present invention.

What is claimed is:

1. A tube-in-tube heat exchanger for exchanging heat between two fluids, the tube-in-tube heat exchanger comprising:

at least one tube pair having an inner tube disposed within and protruding from an outer tube, the inner tube and the outer tube each having open end portions;

spaced apart first and second tube sheets, each tube sheet having a number of bores therein for receiving each tube pair, the number of bores is equal to the number of tube pairs; wherein each open end portion of each outer tube of each tube pair is connected to each tube sheet in flow communication with each bore and wherein each inner tube extends through each tube sheet;

a first annular flow chamber, a second annular flow chamber, an annular fluid inlet and an annular fluid outlet; wherein the annular fluid inlet and the annular fluid outlet are each positioned in an operable relationship to the first annular flow chamber and the second annular flow chamber; each annular flow chamber having an inner face and an outer face spaced apart from each inner face, wherein each inner face and each outer face has a number of bores therein for receiving each inner tube, wherein the number of bores is equal to the number of inner tubes and each bore has edges; the inner face of each annular flow chamber is attached to each tube sheet on a side opposite to each tube pair, the inner face and the tube sheet have a gasket therebetween; each inner tube extends through each bore in each inner face, passes through the annular flow chamber and protrudes from each bore in each outer face;

a first inner tube flow chamber, a second inner tube flow chamber, an inner tube fluid inlet and an inner tube fluid outlet; wherein the inner tube fluid inlet and the inner tube fluid outlet are each positioned in an operable relationship to the first inner tube flow chamber and the second inner tube flow chamber; each inner tube flow chamber having an inner face and an opposing outer face spaced apart from the inner face, an outer cover plate adjacent to the opposing outer face having a gasket disposed therebetween; wherein each inner face of each inner tube flow chamber is placed in flow communication with each outer face of each annular flow chamber; each inner face having a number of bores therein for receiving each inner tube and wherein the number of bores is equal to the number of inner tubes and each bore has edges; and an inner tube gasket surrounding each inner tube at each open end portion, the inner tube gasket disposed between each outer face of each annular flow chamber and each inner face of each inner tube flow chamber wherein the inner tube gasket surrounding each inner tube is compressed to form a seal between the outer face of each annular flow chamber, the inner face of each inner tube flow chamber, and each inner tube.

2. The tube-in-tube heat exchanger according to claim 1, wherein each inner tube has a modified heat transfer surface to generate turbulent flow.

3. The tube-in-tube heat exchanger according to claim 2, wherein the modified heat transfer surface is fluted.

4. The tube-in-tube heat exchanger according to claim 1, wherein the first and second annular flow chambers further comprise at least one partition for directing fluid flow, the partition is positioned between the inner face and the outer face of at least one annular flow chamber; and wherein the first and second inner tube flow chambers further comprise at least one partition for directing fluid flow, the partition is positioned between the inner face and the outer face of at least one inner tube flow chamber.

5. The tube-in-tube heat exchanger according to claim 1, wherein the edges of the bores of the outer face of each annular flow chamber and the edges of the bores of the inner face of each inner tube flow chamber are modified for enhanced sealing by the inner tube gasket.

6. The tube-in-tube heat exchanger according to claim 5, wherein the edges of the bores of the outer face of each annular flow chamber and the edges of the bores of the inner face of each inner tube flow chamber are grooved.

7. The tube-in-tube heat exchanger according to claim 5, wherein the edges of the bores of the outer face of each annular flow chamber and the edges of the bores of the inner face of each inner tube flow chamber are chamfered.

8. The tube-in-tube heat exchanger according to claim 1, wherein the first annular flow chamber has an annular fluid inlet and an opposing annular fluid outlet; and wherein the first inner tube flow chamber has an inner tube fluid inlet and an opposing inner tube fluid outlet.

9. The tube-in-tube heat exchanger according to claim 1, wherein the first annular flow chamber has an annular fluid inlet, the second annular flow chamber has an annular fluid outlet; and the first inner tube flow chamber has an inner tube fluid outlet, and the second inner tube flow chamber has an inner tube fluid inlet.

10. A tube-in-tube heat exchanger for exchanging heat between two fluids, the tube-in-tube heat exchanger comprising:

at least one tube pair having an inner tube disposed within and protruding from an outer tube, the inner tube having a modified heat transfer surface and wherein the inner tube and the outer tube each have plain open end portions;

spaced apart first and second tube sheets, each tube sheet having a number of bores therein for receiving each tube pair, the number of bores is equal to the number of tube pairs, wherein each open end portion of each outer tube of each tube pair is connected to each tube sheet in flow communication with each bore and wherein each inner tube extends through each tube sheet;

first annular flow chamber and a second annular flow chamber, the first annular flow chamber having an annular fluid inlet and the second annular flow chamber having an annular fluid outlet, each annular flow chamber having an inner face and an outer face spaced apart from the inner face, wherein each inner face and each outer face has a number of bores therein for receiving each inner tube, the number of bores is equal to the number of inner tubes; the inner face of each annual flow chamber is attached to each tube sheet on a side opposite to each tube pair, the inner face and the tube sheet have a gasket therebetween; each annular flow chamber having at least one partition for directing annular fluid flow positioned between each inner face and each outer face, and wherein each inner tube extends through each bore in each inner face of each annular flow chamber and protrudes from each bore in each outer face;

a first inner tube flow chamber and a second inner tube flow chamber, the first inner tube flow chamber having an inner tube fluid outlet and the second inner tube flow chamber having an inner tube fluid inlet; each inner tube flow chamber having an inner face having a number of bores therein for receiving each inner tube, the number of bores is equal to the number of inner tubes, an opposing outer face and an outer cover plate adjacent to the opposing outer face with a gasket therebetween; wherein each inner face of each inner tube flow chamber is placed in flow communication with each outer face of each annular flow chamber; at least one partition for directing inner tube fluid flow, the partition positioned between each inner face and each outer face of each inner tube flow chamber; and an inner tube gasket surrounding each inner tube at each open end portion and disposed between the outer face of each annular flow chamber and the inner face of each inner tube flow chamber wherein the inner tube gasket is compressed to form a seal between the outer face of each annular flow chamber, the inner face of each inner tube flow chamber, and each inner tube.

11. A tube-in-tube heat exchanger for exchanging heat between two fluids, the tube-in-tube heat exchanger comprising:

at least two tube pairs, each tube pair having an inner tube disposed within and protruding from an outer tube, each inner tube having a modified heat transfer surface and wherein the inner tube and the outer tube each have plain open end portions;

spaced apart first and second tube sheets, each tube sheet having a number of bores therein for receiving each tube pair, the number of bores is equal to the number of tube pairs, wherein each open end portion of each outer tube of each tube pair is connected to each tube sheet in flow communication with each bore and wherein each inner tube extends through each tube sheet;

a first annular flow chamber and a second annular flow chamber, the first annular flow chamber having an annular fluid inlet and an opposing annular fluid outlet; each annular flow chamber having an inner face and an outer face, spaced apart from each inner face, wherein each inner face and each outer face has a number of bores therein for receiving each inner tube, wherein the number of bores is equal to the number of inner tubes; each inner face of each annular flow chamber is attached to each tube sheet on a side opposite to each tube pair, each inner face and each tube sheet have a gasket therebetween: each annual flow chamber has at least one partition for directing annular fluid flow, the partition positioned between each inner face and each outer face; and wherein each inner tube extends through each annular flow chamber and protrudes from each bore in each outer face;

a first inner tube flow chamber and a second inner tube flow chamber, the first inner tube flow chamber having an inner tube fluid inlet and an opposing inner tube fluid outlet; wherein each inner tube flow chamber has an inner face and an opposing outer face spaced apart from the inner face, an outer cover plate adjacent to the opposing outer face, and a gasket disposed between the outer face and the outer cover plate; at least one partition for directing inner tube fluid flow, the partition positioned between each inner face and each opposing outer face; each inner face of each inner tube flow chamber is placed in flow communication with each outer face of each annular flow chamber; each inner face has a number of bores therein for receiving each inner tube, the number of bores is equal to the number of inner tubes; and an inner tube gasket surrounding each inner tube at each open end portion, the inner tube gasket disposed between each outer face of each annular flow chamber and each inner face of each inner tube flow chamber wherein each gasket surrounding each inner tube is compressed to form a seal between the outer face of each annular flow chamber, the inner face of each inner tube flow chamber, and each inner tube.

12. A tube-in-tube heat exchanger for exchanging heat between two fluids, the tube-in-tube heat exchanger comprising:

two tube pairs, each tube pair having an inner tube disposed within and protruding from an outer tube, each inner tube having a modified beat transfer surface and wherein the inner tube and the outer tube each have plain open end portions;

spaced apart first and second tube sheets, each tube sheet having a number of bores therein for receiving each tube pair, the number of bores is equal to the number of tube pairs, wherein each open end portion of each outer tube of each tube pair is connected to each tube sheet in flow communication with each bore and wherein each inner tube extends through each tube sheet;

a first annular flow chamber and a second annular flow chamber, the first annular flow chamber having an annular fluid inlet and an opposing annular fluid outlet; each annular flow chamber having an inner face and an outer face, spaced apart from each inner face, wherein each inner face and each outer face has a number of bores therein for receiving each inner tube, wherein the number of bores is equal to the number of inner tubes; each inner face of each annular flow chamber is attached to each tube sheet on a side opposite to each tube pair, each inner face and each tube sheet have a gasket therebetween; the second annular flow chamber has a partition for directing annular fluid flow, the partition positioned between the inner face and the outer face; and each inner tube extends through each annular flow chamber and protrudes from each bore in each outer face;

a first inner tube flow chamber and a second inner tube flow chamber, the first inner tube flow chamber having an inner tube fluid inlet and an opposing inner tube fluid outlet; wherein each inner tube flow chamber has an inner face and an opposing outer face, spaced apart from the inner face, an outer cover plate adjacent to the opposing outer face, and a gasket disposed between the outer face and the outer cover plate; the second inner tube flow chamber has a partition for directing inner tube fluid flow, the partition positioned between the inner face and the opposing outer face; each inner face of each inner tube flow chamber is placed in flow communication with each outer face of each annular flow chamber; each inner face has a number of bores therein for receiving each inner tube, the number of bores is equal to the number of inner tubes; and an inner tube gasket surrounding each inner tube at each open end portion, the inner tube gasket disposed between each outer face of each annular flow chamber and each inner face of each inner tube flow chamber wherein each gasket surrounding each inner tube is compressed to form a seal between the outer face of each annular flow chamber, the inner face of each inner tube flow chamber, and each inner tube.

13. A method for assembling a tube-in-tube heat exchanger, the method comprising the steps of:

a) providing at least one tube pair, wherein each tube pair has an inner tube disposed within and protruding from an outer tube;

b) attaching a first end of each outer tube to a first tube sheet and a second end of each outer tube to a second tube sheet and extending each inner tube therethrough;

c) positioning and attaching a first annular flow chamber in flow communication with the first tube sheet and a second annular flow chamber in flow communication with the second tube sheet, wherein a gasket is disposed between each tube sheet and each annular flow chamber, and extending each inner tube through each annular flow chamber;

d) attaching a gasket to each end of each inner tube; and e) positioning and attaching a first inner tube flow chamber in flow communication with the first annular flow chamber and a second inner tube flow chamber in flow communication with the second annular flow chamber wherein each gasket attached to each end of each inner tube is compressed between each inner tube flow chamber and each annular flow chamber.

14. The method according to claim 13, wherein each inner tube has a modified heat transfer surface to generate turbulent flow.

15. The method according to claim 13, wherein the modified heat transfer surface is fluted.

16. The method according to claim 13, further comprising the step of inserting at least one partition within the first and second annular flow chambers and the first and second inner tube flow chambers.

17. The method according to claim 13, further comprising the step of inserting at least one partition within one annular flow chamber and one inner tube flow chamber.

* * * * *